US005395275A

United States Patent [19]

Johnson et al.

[11] Patent Number: 5,395,275

[45] Date of Patent: Mar. 7, 1995

[54] TOY AIRPLANE AND LAUNCHER

[76] Inventors: Lonnie Johnson, 1640 Roswell St., Ste. A, Smyrna, Ga. 30080; John T. Applewhite, 138 Belmont Dr. SW., Atlanta, Ga. 30311

[21] Appl. No.: 103,571

[22] Filed: Aug. 9, 1993

[51] Int. Cl.[6] ..... A63H 27/14; A63H 27/22

[52] U.S. Cl. ..... 446/60; 446/65; 446/429

[58] Field of Search ..... 446/39–42, 446/59, 60, 64, 65, 261, 429, 430

[56] References Cited

U.S. PATENT DOCUMENTS

| | | | |
|---|---|---|---|
| 1,565,437 | 12/1925 | Greife | 446/65 |
| 3,605,328 | 9/1971 | Kilroy | 446/41 |
| 3,721,317 | 3/1973 | Gay | 446/60 X |
| 4,946,417 | 8/1990 | Ishikawa et al. | 446/430 |
| 5,129,852 | 7/1992 | Crisli et al. | 446/65 X |

FOREIGN PATENT DOCUMENTS

| | | | |
|---|---|---|---|
| 408415 | 11/1910 | France | 446/59 |
| 428855 | 9/1911 | France | 446/59 |

*Primary Examiner*—Danton D. DeMille
*Attorney, Agent, or Firm*—Hopkins & Thomas

[57] ABSTRACT

A toy airplane and launcher assembly comprises a rubber band powered toy airplane having a propeller at its front end, a winding coupler disposed at its rear end, and a pair longitudinally aligned sleeves mounted to its belly. A rubber band extends between the propeller shaft and the winding coupler shaft. A pistol-shaped launcher includes a handle and with an elongated guide rod extending therefrom. The guide rod is sized to be received through the aligned sleeves of the airplane to mount the plane on the launcher and a latch releasable latches the plane in place when the guide rod is fully received through the sleeves. A coil spring extends about the guide rod and is progressively compressed as the plane is mounted on the launcher to catapult the plane from the launcher when the latch is released. A manually operated winding mechanism is mounted in the launcher handle and includes a winding coupler that is positioned to engage and mate with the airplane's coupler head when the plane is mounted to the launcher. The winding mechanism can then be operated to rotate the mated couplers and thus wind the plane's rubber band before the plane is projected from the launcher.

11 Claims, 3 Drawing Sheets

TOY AIRPLANE AND LAUNCHER

FIELD OF THE INVENTION

The present invention relates generally to toys and more particularly to wind-up toy airplanes and launchers therefor.

BACKGROUND OF THE INVENTION

Powered toy airplanes having props driven by a wound rubber band have long amused and entertained both children and adults alike. Some such toy airplanes have been provided with launchers designed to propel or launch the plane into the air for flight. U.S. Pat. No. 1,565,437 of Greife, for example, discloses a toy airplane and launcher having an airplane with a spring driven propeller that is wound manually before the plane is mounted in a spring-loaded catapulting launcher. U.S. Pat. No. 2,426,437 of Cole, et al discloses a similar device wherein a toy glider airplane is forcibly propelled from a pistol-shaped launcher by means of a pre-tensioned rubber band. Other examples of this type of toy plane and launcher system include the devices disclosed in U.S. Pat. Nos. 3,496,671 of Korona; 2,035,131 of Kkeinberg; 3,902,271 of Turoff; and 3,031,797 of Gelfand.

A more recent example of a toy airplane and launcher is embodied in the apparatus disclosed in U.S. Pat. No. 5,129,852 of Crisci, et al. In Crisci, et al the toy airplane includes a propeller that is driven by a wound rubber band to power the plane for flight. The plane is mountable on a pistol-shaped rubber band powered launcher that, when activated, propels and projects the toy plane forcibly into the air for flight.

Crisci, et al also includes a separate electrically powered winding device having a rubberized suction cup-like coupler that spins when the winder is activated. For use, the rubberized coupler is pressed onto the propeller's hub cap and the winder is activated, causing the coupler and thus the propeller to spin, thereby winding up the plane's rubber band in preparation for flight.

In one of the Crisci, et al embodiments, the toy airplane has a propeller mounted on the back end of the plane in a pusher-prop configuration. In this embodiment, the electrically operated winder can be mounted temporarily onto the back of the launcher and adjusted so that its rubberized coupler engages the prop's hub cap when the plane is fully mounted onto the launcher. Thus, the plane can be mounted onto its launcher whereupon the electric winder is activated to wind the propeller thereby winding up the rubber band in preparation for flight.

While prior devices such as those disclosed in the above referenced patents appear to be somewhat successful in providing a toy airplane and launcher system that is more convenient than purely manual systems, they nevertheless exhibit various problems and shortcomings that are inherent in their respective designs. In all but the Crisci, et al device, for example, the toy airplane is either a simple glider or has a rubber band or spring powered propeller that must be wound up manually before the plane is loaded onto the launcher. Crisci, et al attempts to address this problem by providing a battery powered electrical winder, which at least eliminates some of the effort required in winding up the plane's rubber band. However, the Crisci, et al device exhibits its own new set of problems and shortcomings. For example, the winder of Crisci, et al, being electrically operated, always requires a fresh set of batteries. Without such batteries, the winder is useless and one is forced to abandon the winder and simply wind up the plane's rubber band by hand in the old fashion way. This is particularly troublesome in a children's toy, which can remain in storage for long periods of time, such as over the winter, between uses. Further, the winder mechanism of Crisci, et al is complicated, expensive to manufacture, likely to be misplaced, and subject to failure under the sometimes rough treatment of children. Also, since the winder of Crisci, et al is electrically operated, its user is not provided with direct feedback regarding how tightly the plane's rubber band is being wound so that the rubber band can easily be under or over wound and can even be wound until the rubber band breaks.

Thus, a need exists for an improved toy airplane and launcher system that overcomes the problems and shortcomings of the prior art by providing a toy plane that is propeller powered and that can be wound up simply and without the need for batteries after the plane is loaded onto the launcher. The winding mechanism should be simple and rugged, easy to operate by children, non-detachable, and should allow its user to determine the degree to which the plane's rubber band motor is being wound to avoid over or under winding. It is to the provision of such a toy airplane and launcher system that the present invention is primarily directed.

SUMMARY OF THE INVENTION

Briefly described, the present invention, in a preferred embodiment thereof, comprises a toy airplane and launcher system including a toy airplane that is driven by a propeller which, in turn, is powered by a windable rubber band extending through the fuselage of the plane. The rubber band is attached to the propeller shaft at the front end of the airplane and to the shaft of a uni-directional rotatable coupler at the rear end of the airplane. The head of the uni-directional coupler extends through the back end of the plane's fuselage. With this arrangement, the rubber band motor of the plane can be wound up either by holding the plane and spinning the prop in the usual way or by holding the prop and rotating the head of the uni-directional coupler at the back end of the plane.

The launcher of the system is generally pistol-shaped and includes a handle from which an elongated guide rod barrel extends. A pair of aligned annular sleeves are mounted on the belly of the toy plane's fuselage and are sized to receive the guide rod of the launcher for loading the plane onto the launcher. The rear annular sleeve of the plane is configured to be releasable latched by the launcher's trigger mechanism when the plane is fully mounted onto the guide rod of the launcher.

A coiled compression spring extends along and surrounds the guide rod. The compression spring has a diameter greater than the inner diameter of the annular sleeves. With this configuration, it can be seen that as the plane is loaded onto the launcher by progressively sliding the launcher's guide rod through the plane's annular sleeves, the coiled compression spring becomes compressed between the rear sleeve and the handle of the launcher. When the plane is fully mounted onto the guide rod, its rear sleeve is releasable latched in place by the trigger mechanism, thus releasable locking the plane on the launcher. Upon release of the trigger, the compression spring expands rapidly against the plane's rear sleeve thus catapulting the plane forcibly from the launcher and into the air for flight.

A manually operated winding mechanism is built into the handle portion of the launcher at the back end of the guide rod. The winding mechanism comprises a primary shaft about which a sheave and primary gear are rotatably mounted. The sheave and primary gear are coupled together by a one-way clutch such that the primary gear is rotated by the sheave when the sheave rotates in one direction but is not rotated by the sheave when the sheave is rotated in the other direction.

A string is wrapped about the sheave and extends outside the handle to terminate in an annular ring sized to receive the finger of a user. The string is wound about the sheave in a direction that causes the sheave and the primary gear to rotate when the ring is grasped and pulled away from the launcher. A coil spring that extends about the primary shaft is fixed at one end and coupled at its other end to the sheave. Thus, the coil spring winds up as the string is pulled to rotate the sheave and primary gear. When the string is released, the coil spring unwinds causing the sheave but not the primary gear to rotate in the other direction thereby rewinding the string back onto the sheave. It will thus be appreciated that with the just described mechanism, the string can be pulled alternately in and out by a user, which causes the primary gear to be rotated intermittently in a single direction.

The winding mechanism also includes a secondary gear that is coupled to the primary gear and fixed to a secondary shaft so that the secondary shaft rotates whenever the secondary gear is rotated. The secondary shaft extends through the launcher handle to terminate just above and at the rear end of the guide rod in a winding coupler that is shaped to mate with the coupler head on the back of the toy plane when the two coupler heads are brought together. Thus, when the primary gear of the winding mechanism is rotated by pulling the string, the secondary gear, secondary shaft, and winding coupler are also caused to rotate in unison.

The winding coupler on the launcher is carefully positioned to align and mate with the coupler head on the toy plane when the plane is fully mounted and releasable latched in place on the launcher. Thus, when the toy plane is fully mounted on the launcher and the winding string pulled, the mated couplers are rotated causing the rubber band within the plane to be wound up in preparation for flight. Further, as the string is alternately pulled in and out of the winder, the increasing tension in the rubber band is transferred to the string providing the user with an indication of the degree to which the rubber band is being wound. Naturally, the winder is arranged so that a pull on the string winds the plane's coupling head and rubber band motor in the proper direction for driving the plane forward as its propeller is spun by the tensioned rubber band. Once the rubber band is wound, the launcher can be grasped like a pistol, aimed, and fired to propel the toy airplane into the air for powered flight.

Accordingly, the present invention provides a greatly improved toy airplane and launcher that addresses and solves the inherent problems of prior art devices. Specifically, the winding mechanism of this invention is rugged, simple and inexpensive to construct, reliable, and does not require the use of batteries or other auxiliary power that can fail. The mechanism also provides constant feedback to a user as the winder is operated to allow the user to judge the degree of tension being imparted to the rubber band and thus to avoid over or under winding. These and numerous other objects, features, an advantages of the present invention will become more apparent upon review of the detailed description portion of this specification and the accompanying drawings, which are briefly described as follows.

DETAILED DESCRIPTION OF THE PREFERRED EMBODIMENT

Figure 1:
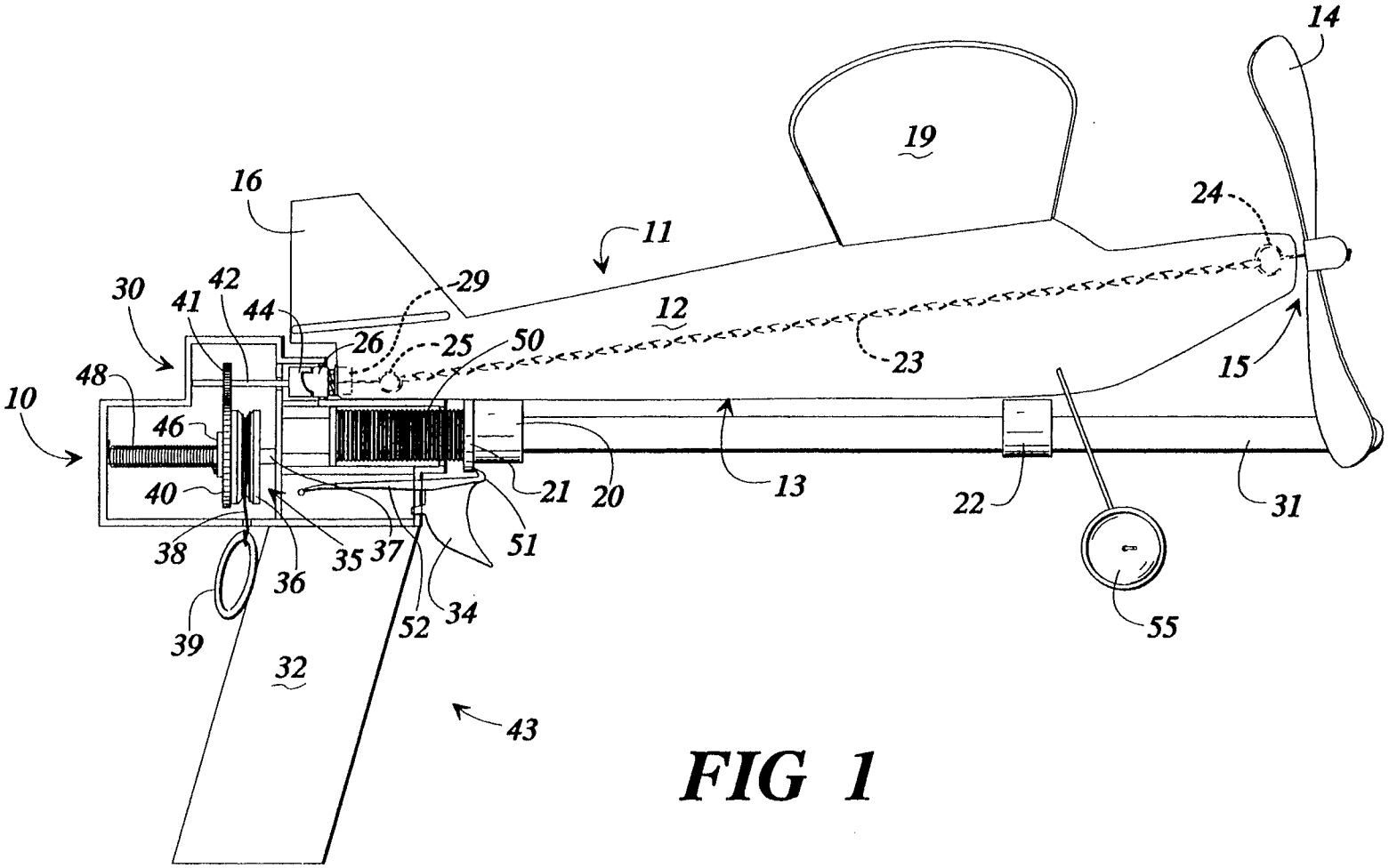
FIG. 1 is a side elevational and partially cut-away view of a toy airplane and launcher that embodies principles of the present invention in one preferred form.

Referring now in more detail to the drawings, in which like numerals refer to like parts throughout the several views, FIG. 1 illustrates a preferred embodiment of the toy airplane and launcher of the present invention showing the plane loaded onto the launcher. The toy airplane 11 includes a fuselage 12, wings 19, and a stabilizer 16. The fuselage 12 includes a front end portion 15 and a rear end portion 18 (FIG. 2) located just below the stabilizer 16.

A propeller shaft 24 extends through the front end portion 15 of the fuselage 12 and has a crooked interior end inside the fuselage and an exterior end located outside of the fuselage. A propeller 14 is mounted on and rotatable with the exterior end of the propeller shaft 24. When rotated or spun in the proper direction, the propeller forces air rearwardly and over the wings 19 to facilitate forward motion and flight of the airplane 11.

A winding shaft 25 rotatably extends through a grommet 29 that is fixed in the rear end portion of the fuselage 12. The winding shaft 25 has a crooked interior end inside the fuselage and an exterior end outside of the fuselage. A coupler head 26 is fixed to the exterior end of the winding shaft 25 so that the shaft 25 and coupler head 26 rotate together in unison. A pair of matching ramped ratchet teeth 27 (FIG. 3) are formed on facing surfaces of the coupler head 26 and the grommet 29. As described in more detail below, these ratchet teeth are configured to allow the coupler head 26 and thus the winding shaft 25 to rotate in one direction while preventing their rotation in the other direction. Accordingly, the ratchet teeth 27 define a one way clutch assembly between the coupler head 26 and the grommet 29.

Tensioning means, which in the preferred embodiment comprises a rubber band 23, is attached at its ends to and extends between the crooked interior end of the propeller shaft 24 and the crooked interior end of the winding shaft 25. It will be understood that when the rubber band 23 is wound up and twisted about its longitude and axis, it provides, when released, rotary power that spins the propeller 14 and drives the toy plane 11 through the air. In this regard, the ratchet teeth 27 are configured to prevent rotation of the coupler head 26 by the rubber band 23 as the rubber band unwinds thereby insuring that all of the rotary energy stored in the rubber band is imparted to the propeller.

A generally annular rear sleeve 20 and a generally annular front sheave 22 are securely mounted to the belly 13 of the airplane's fuselage 12 and are arranged in spaced aligned relationship with respect to the airplane. The rear sleeve 20 is formed with a radially extending collar 21. The spaced aligned sleeves 20 and 22 are used to mount the toy airplane 11 onto its launcher as described in more detail hereinbelow.

With the just described toy airplane configuration, it will be understood that the toy plane's rubber band motor can be wound up in two ways. First, the plane 11 can be held and its propeller 14 twisted with a finger or the like in a clockwise direction as viewed from the front of the airplane. As the propeller 14 is twisted, the tendency of the rubber band to rotate the winding shaft 25 and coupler head 26 is counteracted by the ramped ratchet teeth 27. The winding shaft 25 thus becomes essentially a fixed point of attachment for the rear end of the rubber band 23. When the propeller is released, the energy stored in the wound up rubber band is transferred to the propeller shaft 24 and thus to the propeller causing the propeller to spin and drive the airplane.

A second method of winding the rubber band is to secure the propeller 14 and rotate the coupler head 26 and thus the winding shaft 25 in a clockwise direction as viewed from the rear of the plane. During this winding process, the ratchet teeth 27 allow clockwise rotation of the coupler head 26 but, when the coupler head is released, the ratchet teeth engage to prevent counter clockwise rotation of the winding shaft. Thus, as with the first method, when the airplane is released, the winding shaft 25 becomes a fixed point of attachment and the rotary energy stored in the rubber band is released to the propeller.

The launcher for the system of the present invention is generally pistol shaped and has a handle 32 from the upper portion of which an elongated barrel-like guide rod 31 extends. As seen in FIG. 1, the guide rod 31 is sized to be received through the spaced aligned sleeves 20 and 22 mounted to the belly of the airplane 11. Furthermore, the guide rod 31 has a length that is sufficient to engage the propeller 14 and prevent the rotation thereof when the guide rod 31 is fully received through the sleeves 20 and 22 and the plane fully mounted onto the launcher 43.

A trigger 34 is secured to a leaf spring 52 that is formed with a hook 51 at its forward end portion. In this way, the hook 51 is normally biased upwardly toward the guide rod 31 by the leaf spring 52. When the trigger 34 is pulled, however, the leaf spring 52 is bent downwardly and the hook is pulled away from the guide rod. As best illustrated in FIG. 1, the hook 51 of the trigger mechanism is positioned to latch releasable onto the collar 21 of the rear sleeve 20 when the airplane 11 is fully mounted onto the launcher. Thus, as the plane is progressively loaded onto the launcher, the hook 51 snaps over the collar 20 to hold the plane in place and, when the trigger 34 is pulled, the hook 51 releases the collar and thus releases the plane from the launcher.

Figure 2:
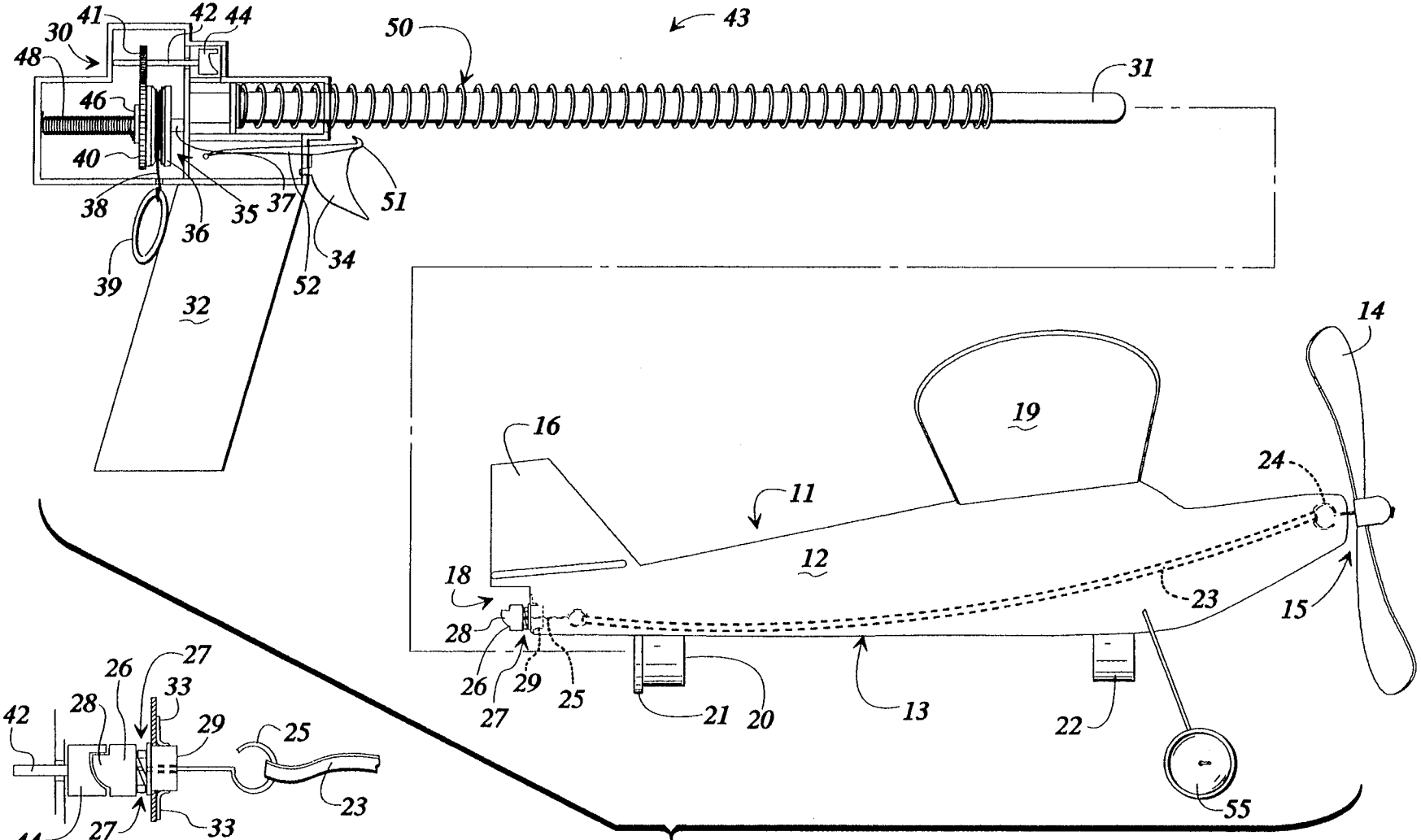
FIG. 2 is a side elevational view showing the toy airplane dismounted from the launcher.

A coiled compression spring 50 extends about and along the length of the guide rod 31 (See FIG. 2). The spring 50 has a diameter that is larger than the inside diameter of the annular sleeve 20 on the airplane. Thus, as the guide rod 31 is received through the sleeves 20 and 22 while mounting the plane to the launcher, the spring 50 becomes progressively more compressed thus applying increasing forward force to the rear sheave 20. The characteristics of the coil spring 50 are selected so that it becomes substantially fully compressed when the plane is completely mounted onto the launcher and the trigger mechanism is latched onto the collar 21. With this configuration, it will be understood that when the trigger 34 is depressed, the hook 51 releases the collar 20 and the force of the coil spring 50 catapults the sleeves 20 and 22 rapidly along and off of the guide rod 31 and thus projects the toy airplane 11 forcibly into the air for flight.

A manually operated winding mechanism 35 is built into the handle portion of the launcher 43 for winding up the toy airplane's rubber band 23 when the plane is fully mounted onto the launcher. The winding mechanism 35 includes a primary shaft 37 about which a sheave 36 is rotatably mounted. The sheave 36 is formed with an annular hub 46 that extends rearwardly of the sheave. A coil spring 48 extends about the primary shaft 37 and is fixed at its rear end to the handle casing and is fixed at its front end to the hub 46 of the sheave 36. With this configuration, the sheave is rotatably biased by the spring 48 to a normal position. When the sheave is rotated about the shaft away from the normal position and released, the spring 46 will tend to return the sheave to its normal biased position.

A string 38 is wrapped about the sheave 36 and the end of the string 38 extends outside the handle casing where it is firmly attached to a ring 39 sized to receive the finger of a user. In the embodiment of FIG. 1, the string 38 is wrapped from its ringed end about the sheave in a clockwise direction as viewed from the rear of the launcher. Thus, when the ring 39 is grasped and pulled, the string is unwound from about the sheave thereby forcing the sheave to rotate about the primary shaft 37 in a counter clockwise direction as viewed from the rear of the launcher. When the string is released, then, the coil spring 48 causes the sheave 36 to rotate back in a clockwise direction to its normal position, thus rewinding the string onto the sheave. Accordingly, it will be seen that the sheave can be intermittently rotated by alternately pulling the ring 39 away from the launcher and allowing it to be pulled back to the launcher by the force of the spring 48.

A primary gear 40 is mounted about the hub 46 of the sheave 36. A uni-directional ratchet type clutch 47 (FIG. 4) similar to the ramped toothed clutch 27 (FIG. 3) is formed in and disposed between the sheave 36 and the primary gear 40. The ratchet type clutch 47 defines a coupling means that functionally couples together the primary gear 40 and the sheave 36 as described in more detail below. The teeth of this clutch are configured to engage and cause the primary gear 40 to be rotated by the sheave when the sheave turns in a counter clockwise direction as viewed from the rear of the launcher but to disengage to allow the sheave to turn without turning the primary gear when the sheave is turned by the spring 48 in a clockwise direction. Thus, the primary gear 40 is rotated in a counter clockwise direction when the ring 39 is pulled away from the handle but is not forced to rotate in the other direction while the spring 48 is rewinding the string back onto the sheave 36. Therefore, with intermittent pulling on the ring 39, the primary gear 40 rotates intermittently and only in a counter clockwise direction but not a clockwise direction as seen from the rear of the launcher in FIG. 1.

A smaller secondary gear 41 is located above the primary gear 40 and is coupled thereto so that rotation of the primary gear 40 causes rotation of the secondary gear 41. The secondary gear 41 is fixed to and rotatable with a secondary shaft 42. The secondary shaft 42 extends through the wall of the launcher handle to an exterior end located above and at the rear of the guide rod 31. A winding coupler 44 is fixed to the exterior end of the secondary shaft 42 such that the secondary gear 41, secondary shaft 42, and winding coupler 44 all rotate together in unison. With this arrangement, when the ring 39 is pulled away from the launcher handle, the primary gear 40 rotates in a counter clockwise direction as viewed from the rear of the launcher, which causes the secondary gear 41 and the winding coupler 44 to rotate in a clockwise direction as seen from the rear of the launcher. It will thus be seen that alternately pulling the ring 39 away from the launcher causes the winding coupler 44 to rotate intermittently in a clockwise direction as seen from the rear of the launcher.

Figure 3:
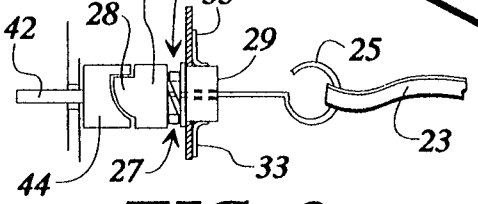
FIG. 3 is a side elevational close-up view of the winding coupler and coupler head mated together for winding as they appear when the plane is mounted on the launcher.
Figure 4:
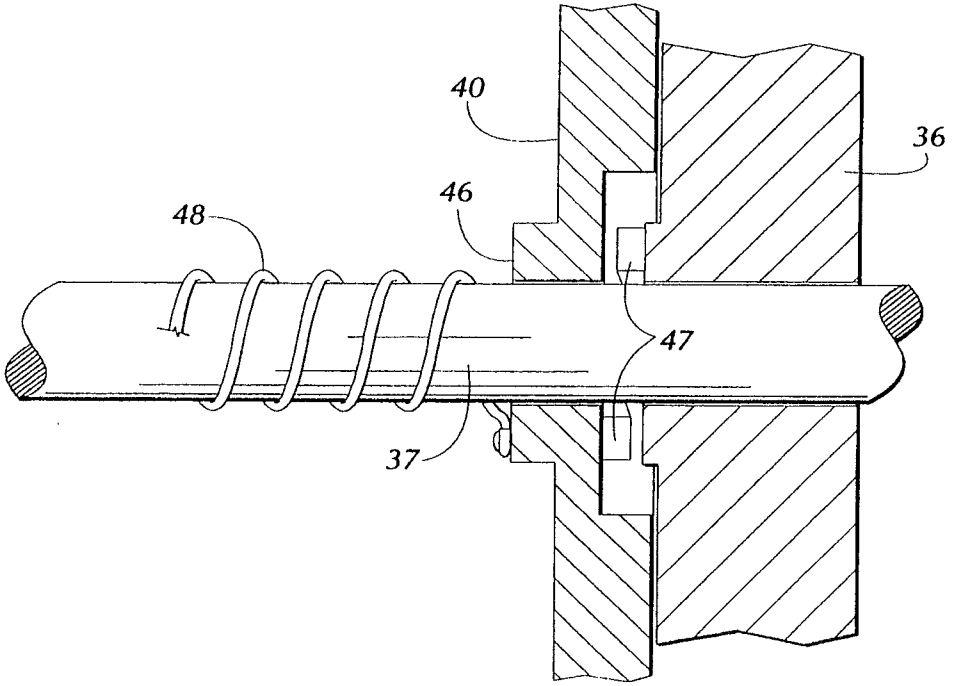
FIG. 4 is a side elevation close up view of the primary gear, sheave, and clutch arrangement.

As best seen in FIG. 3, the winding coupler 44 is shaped to mate with the coupler head 26 on the airplane when the two couplers are brought together. Further, the winding coupler is positioned to engage the coupler head 26 on the back of the toy airplane 11 when the toy airplane is fully loaded onto the launcher. Thus, with the plane loaded onto the launcher, the user can reciprocate the string in and out of the launcher causing the winding coupler 44 and mated coupling head 26 to rotate intermittently in a clockwise direction. This, in turn, causes the winding shaft 25 within the airplane to rotate, which winds up the rubber band 23. Between pulls of the ring 39, the ratchet teeth 27 formed between the coupler head 26 and the grommet 29 engage to prevent the stored power in the rubber band from spinning the mated couplers back in a counter clockwise direction.

Therefore, the plane's rubber band 23 becomes increasingly more tensioned as the ring 39 and string 38 are pulled intermittently away from the launcher. Furthermore, as the rubber band 23 becomes more tensioned, the increased tension is transferred through the mated couplers, secondary gear 41, and primary gear 40 to the sheave 36. Therefore, the string 38 becomes harder and harder to pull as the rubber band 23 winds tighter and tighter about itself. A user is thus able to determine the degree to which the rubber band has been tensioned and can stop the winding process at the appropriate time to prevent over or under winding.

When the rubber band 23 has been fully wound as just described, the launcher 43 can be grasped by its handle and pointed in a desired direction. The trigger 34 can then be pulled, which release the rear sleeve 20 and thus the airplane 11 from its latched position on the launcher. With the airplane released, the coil compression spring 50 forces the airplane rapidly off of and away from the launcher thus propelling it into the air for flight. As the propeller 14 moves past the end of the guide rod 31 during launch, it begins to spin so that the when the plane leaves the launcher it is fully powered for its imminent flight. The characteristics of the compression spring 50 are chosen to catapult the airplane into the air with sufficient force to provide immediate flight so that the propeller does not have to waste energy bringing the plane up to flying speed.

FIG. 2 shows the toy airplane and launcher of the present invention with the airplane dismounted from the launcher. In this configuration, the coil compression spring 50 is seen to be extended to its full length, which substantially spans the length of the guide rod 31.

FIG. 3 is a detailed illustration showing the configuration of the mated winding coupler 44, coupler head 26, ramped ratchet teeth 27, and grommet 29. Specifically, the grommet 29 is seen to be fastened securely and immovably in the rear end of the fuselage 12 by means of a spring washer 33 or other suitable fastener. The winding shaft 25 extends through the grommet 29 and the coupler head 26 is securely fixed to the exterior end of the winding shaft 25.

Matching ramped ratchet teeth 27 are formed on respective facing surfaces of the grommet 29 and the coupler head 26. As can be seen from FIG. 3, when the coupler head 26 rotates in a clockwise direction as seen from the rear of the airplane, the ramped portions of the teeth 27 slide past one another to allow such rotation. However, when the coupler head 26 is urged in a counter clockwise direction, the flat portion of the teeth 27 engage and lock together to prevent such counter clockwise rotation. Thus, the coupler head 26 and winding shaft 25 are rotatable in a clockwise direction as seen from the rear of the plane but are not rotatable in a counter clockwise direction. Also, the winding coupler 44 and coupler head 26 are configured such that when the two are mated together as shown in FIG. 3, the winding coupler 44 rotates the coupler head 26 in a clockwise direction to wind the rubber band. Therefore, the coupling between the winding mechanism 35 and the toy airplane 11 is simple, efficient, rugged, and reliable.

The invention has been described herein in terms of a preferred embodiment. It will be clear to those of skill in this art, however, that numerous variations might be made from the illustrated embodiment within the scope of this invention. For example, the directions of rotation of the various elements of the invention have been chosen to be consistent with a propeller that spins counter clockwise as viewed from the front to drive the plane. Obviously, the opposite convention would be equally acceptable. Further, while a string and sheave arrangement has been shown as a method of operating the winding mechanism, other configurations, such as a rotary crank, might also be used with comparable results. Finally, while the invention has been illustrated in terms of a toy airplane, it will be clear to skilled artisans that the principles of the invention might be applied equally well to any toy powered by a windable rubber band or other tensioning means. Thus, the invention should not be construed to be limited by the airplane configuration of the illustrated embodiment. These and various other additions, deletions, and modifications might well be made to the preferred embodiment illustrated herein without departing from the spirit and scope of the invention as set forth in the claims.

We claim:

1. A toy airplane and launcher assembly comprising:

a toy airplane having a fuselage with a front end portion and a rear end portion;

a propeller shaft extending through the front end portion of said fuselage with said propeller shaft having an interior end located within said fuselage and exterior end located outside said fuselage at the front end portion thereof;

a propeller mounted to said exterior end of said propeller shaft with said propeller and said propeller shaft being rotatable together;

a winding shaft extending through the rear end portion of said fuselage with said winding shaft having an interior end located within said fuselage and an exterior end located outside said fuselage at the rear end portion thereof;

a coupler head fixed to the exterior end of said winding shaft with said coupler head and said winding shaft being rotatable together, said coupler head having a forward face formed with a set of ratchet teeth;

windable tensioning means extending within said fuselage between said interior end of said propeller shaft and said interior end of said winding shaft, said tensioning means being adapted to store energy when wound and to release its stored energy as it unwinds to rotate said propeller shaft and said propeller and thus to drive said toy airplane through the air;

said tensioning means being wound by rotation of said coupling head and said winding shaft;

clutch means on the rear end portion of said fuselage for allowing rotation of said coupler head in one direction to wind said tensioning means and to prevent rotation of said coupler head in the opposite direction to provide a fixed point of attachment of said tensioning means at the rear end portion of said fuselage as said tensioning means unwinds to spin said propeller, said clutch means comprising a grommet fixed to said rear end portion of said fuselage, said grommet having a rear face formed with a set of ratchet teeth, said grommet being provided with a central bore through which said winding shaft rotatably extends, said rear face of said grommet being positioned to bear against said forward face of said coupler head with the ratchet teeth on said faces meshing to provide for uni-directional rotation of said coupler head;

a generally pistol-shaped launcher having a handle portion from which an elongated guide rod extends;

mounting means on said airplane fuselage for slidably receiving said elongated guide rod of said launcher for mounting said toy airplane onto said launcher;

latch means for releasably latching said toy airplane to said launcher when said guide rod is fully received by said mounting means;

a winding coupler on said launcher with said winding coupler being rotatable and being configured to mate with said coupler head on said airplane when the winding coupler and coupler head are brought together so that rotation of said winding coupler causes said coupler head to rotate;

said winding coupler being positioned on said launcher to be brought together with said coupler head on said airplane when said airplane is mounted on said launcher and releasably latched in place by said latch means;

winding means on said launcher for selectively rotating said winding coupler and thereby rotating said coupler head to wind said tensioning means when said airplane is mounted and latched to said launcher and said coupler heads are mated together; and means for propelling said toy airplane off of said guide rod for flight upon release of said latch means, whereby the toy airplane can be mounted and releasably latched on the launcher and the winding means operated to rotate the mated winding coupler and coupler head and thereby wind the tensioning means, whereupon the latch means can be released to propel the toy airplane from the launcher and into the air for powered flight.

2. A toy airplane and launcher assembly as claimed in claim 1 and wherein said windable tensioning means comprises a rubber band.

3. A toy airplane and launcher assembly as claimed in claim 1 and wherein said mounting means on said fuselage comprises a pair of spaced aligned sleeves mounted to said fuselage with said sleeves being sized and positioned to receive said elongated guide rod.

4. A toy airplane and launcher assembly as claimed in claim 3 and wherein said latch means comprises an annular lip formed on one of said sleeves and a spring biased hook on said launcher positioned to latch onto said annular lip when said toy airplane is fully mounted on said launcher to hold the airplane in place on the launcher until said spring biased hook is released from said annular lip.

5. A toy airplane and launcher assembly as claimed in claim 1 and wherein said winding means comprises a manually operable winder adapted to rotate said winding coupler in one direction when said winder is operated.

6. A toy airplane and launcher assembly as claimed in claim 5 and wherein said winder includes a rotatable sheave, coupling means for coupling said sheave to said winding coupler such that said winding coupler is rotated when said sheave rotates in one direction and said winding coupler is not rotated when said sheave rotates in the other direction, and string means wrapped about said sheave and extending out of said launcher, whereby the string means can be grasped and pulled to rotate the sheave and thus the winding coupler to wind the tensioning means in the toy airplane.

7. A toy airplane and launcher assembly as claimed in claim 6 and further comprising spring means coupled to said sheave for returning said sheave to its original rotational position after said string means has been pulled to wind said string means back up onto said sheave for subsequent pulls of said string means.

8. A toy airplane and launcher assembly as claimed in claim 7 and wherein said coupling means comprises a primary gear adapted to be rotated by said sheave when said sheave is rotated in one direction and not rotated when said sheave is rotated in the other direction, said primary gear being coupled to rotate a secondary gear that, in turn, is coupled to rotate said winding coupler.

9. A rubber band powered toy airplane comprising a fuselage having a front end and a rear end, a propeller shaft extending through said front end of said fuselage with said propeller shaft having an interior end located within said fuselage and an exterior end located outside of said fuselage at the front end thereof, a propeller mounted on said exterior end of said propeller shaft, a winder shaft extending through the rear end of said fuselage with said winder shaft having an interior end within said fuselage and an exterior end located outside of said fuselage at the rear end thereof, a coupler head fixed to said exterior end of said winder shaft and being rotatable therewith, a rubber band extending within said fuselage between the interior end of said propeller shaft and the interior end of said winder shaft, and clutch means on the rear end portion of said fuselage for allowing in place rotation of said coupler head and said winder shaft in one direction to wind said rubber band while preventing rotation of said coupler head and said winder shaft in the other direction, said clutch means including a grommet fixed to the rear end portion of said fuselage and having a central bore through which said winder shaft extends and a set of ratchet teeth disposed between said grommet and said coupler head, whereby the rubber band can be wound by holding the propeller and rotating the coupler head in the one direction and, when the airplane is released, the clutch means prevents rotation of the coupler head and winder shaft in the other direction to provide a fixed point of attachment of the rubber band for delivering the energy stored in the wound rubber band to the propeller for rotation thereof.

10. A rubber band powered toy airplane as claimed in claim 9 and further comprising a grommet fixed in the rear end of said fuselage with said winder shaft extending rotatably through said grommet and wherein said clutch means comprises a first ramped tooth formed on said grommet at the rear end of said fuselage and a corresponding second ramped tooth formed on said coupler head opposing said first ramped tooth, said ramped teeth being configured to slide past one another when said coupler head rotates in one direction but to engage and lock together to prevent rotation of said coupler head in the other direction.

11. A toy vehicle and launcher assembly comprising;

a vehicle body;

windable tensioning means in said vehicle body with said tensioning means being adapted to provide motive force to drive said vehicle when said tensioning means is wound and released;

a rotatable winding shaft extending through said vehicle body with said winding shaft having an interior end and an exterior end;

a coupler head fixed to the exterior end of said winding shaft with said coupler head and said winding shaft being rotatable together;

said windable tensioning means being fixed at one end to the interior end of said winding shaft and being wound by rotation of said coupler head and said winding shaft;

clutch means on said vehicle body juxtaposed said coupler head for allowing in place rotation of said coupler head in one direction and preventing rotation of said coupler head in the other direction, said clutch means including a grommet through which said winding shaft extends and a set of ratchet teeth provided between said grommet and said coupler head;

launcher means for receiving said vehicle body;

releasable latch means on said launcher means for releasably latching said vehicle body in place on said launcher when the vehicle body is fully received on said launcher;

a winding coupler on said launcher with said winding coupler being rotatable and being configured to mate with said coupler head on said vehicle body when said vehicle body is fully received and releasably latched in place on said launcher;

winding means on said launcher for selectively rotating said winding coupler and thereby rotating said coupler head to wind said tensioning means in said vehicle body when said vehicle body is mounted and releasably latched on said launcher means; and means for releasing said vehicle body from said launcher means to propel said vehicle from the launcher means for powered motion.

* * * * *